United States Patent [19]

Saxton

[11] 4,115,484

[45] Sep. 19, 1978

[54] COOLING TOWER FILL ASSEMBLY

[75] Inventor: Forest Jackson Saxton, Calistoga, Calif.

[73] Assignee: Ecodyne Corporation, Lincolnshire, Ill.

[21] Appl. No.: 834,012

[22] Filed: Sep. 16, 1977

[51] Int. Cl.[2] ..... B01F 3/04

[52] U.S. Cl. ..... 261/111; 261/DIG. 11

[58] Field of Search ..... 261/DIG. 11, 111; 52/714, 484, 489; 248/214, 215, 217.3, 317

[56] References Cited

U.S. PATENT DOCUMENTS

| | | | |
|---|---|---|---|
| 1,628,249 | 5/1927 | Kirfman | 52/484 |
| 2,403,881 | 7/1946 | Tarbox | 52/489 |
| 2,499,278 | 2/1950 | Olsen | 52/714 |
| 2,780,447 | 2/1957 | Kalthoff, Jr. | 261/DIG. 11 |
| 3,058,172 | 10/1962 | Phillips | 52/484 |
| 3,097,821 | 7/1963 | Richards | 248/217.3 |
| 3,389,895 | 6/1968 | De Flon | 261/DIG. 11 |
| 3,390,856 | 7/1968 | Van Buren, Jr. | 248/317 |
| 3,447,823 | 6/1969 | Gregoire | 52/489 |
| 3,468,521 | 9/1969 | Furlong et al. | 261/DIG. 11 |
| 3,643,931 | 2/1972 | Henning et al. | 261/DGIG. 11 |
| 3,667,786 | 6/1972 | Cooper | 52/714 |
| 3,749,381 | 7/1973 | Furlong et al. | 261/DIG. 11 |
| 3,969,865 | 7/1976 | Andersen | 52/489 |
| 4,027,454 | 6/1977 | Schuplin | 52/714 |
| 4,040,758 | 8/1977 | Saver | 52/484 |

FOREIGN PATENT DOCUMENTS

| | | | |
|---|---|---|---|
| 400,994 | 2/1970 | Australia | 52/484 |

*Primary Examiner*—Frank W. Lutter
*Assistant Examiner*—Gregory N. Clements
*Attorney, Agent, or Firm*—Joel E. Siegel; Charles M. Kaplan

[57] ABSTRACT

Cooling tower splash fill strips rest in grids made from interconnected vertical and horizontal wire strands. Each grid is supported at its upper end by a fill hanger beam, which, in turn, is supported by a series of aligned beam hanger clips. The clips are connected to generally horizontal structural members of the cooling tower.

27 Claims, 8 Drawing Figures

COOLING TOWER FILL ASSEMBLY

BACKGROUND OF THE INVENTION

This invention relates to the splash fill of mechanical or natural draft water cooling towers of the crossflow and counterflow types, and more particularly to improvements in the way such fill is supported in a lattice of interconnected wire strands.

In liquid cooling towers the splash fill is commonly supported by a series of wire grids suspended from internal structural components. Such wire grids have been connected to the supporting structure by nailing them to posts, by looping them over notched wooden beams, and by suspending them from hooks. These prior arrangements have disadvantages such as wasting materials, requiring excessive field labor, or increasing the resistance to air flow. Also, they often lack durability because of attack by corrosion or fungus, or they had to be assembled and fitted into place at dangerous heights.

SUMMARY OF THE INVENTION

Accordingly, it is an object of this invention to provide improved support for the splash fill in liquid cooling towers.

Another object is to reduce the amount of fill hanger grid wire used to support cooling tower splash fill strips.

Another object is to support splash fill without having to put notches or holes in beams.

Another object is to increase the distance between the fasteners securing fill hanger grids to structural supports.

Another object is to support splash fill without having to notch and cut out wire panels to fit around tower structure.

Another object is to support splash fill with continuous one piece wire panels in place of multiple panels formerly required to fit around tower structure.

Another object is to more uniformly distribute the load on the upper horizontal supporting strand of a cooling tower fill hanger wire grid.

Another object is to provide a safer way of supporting cooling tower fill by reducing the time spent by workers at elevated levels.

Another object is to provide a fill arrangement that can be partially or completely assembled at ground level, then raised to the proper height and slid horizontally into its supports.

Another object is to provide a rugged, relatively low cost, easily erected liquid cooling tower fill assembly that has minimal air resistance and which does not possess defects found in similar prior art fill support arrangements.

Other objects and advantages of the invention will be apparent from the specification and claims, and the scope of the invention will be pointed out in the claims.

DESCRIPTION OF A PREFERRED EMBODIMENT

Figure 1:
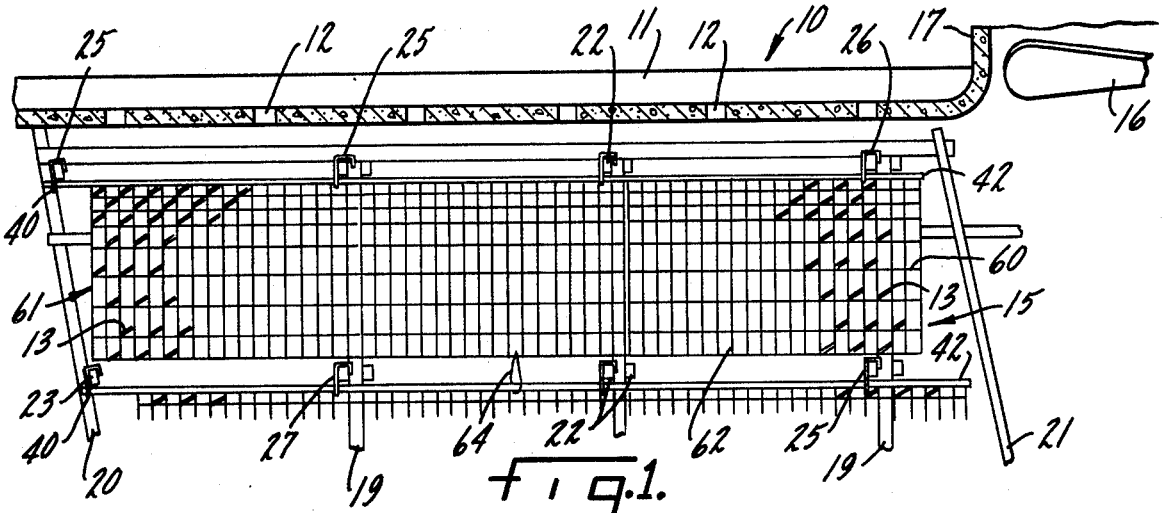
FIG. 1 is a cross sectional, partially broken-away, schematic representation of a cooling tower in accord with this invention.

The drawing shows a portion of a conventional cross flow mechanical draft cooling tower 10 in which water to be cooled is pumped into an upper hot water distribution pan 11 and then flows downwardly through holes or nozzles 12. The water flows through and over conventional splash fill strips 13 held in a fill support assembly 15 in accord with this invention. Air is drawn through the splash fill and falling water by a rotatable fan 16 in stack 17, and the cooled water is pumped from a collection basin below the fill in conventional manner.

The weight of the cooling tower components and the liquid being cooled is supported by numerous generally vertically extending wooden or concrete column means such as tower posts 19, louver support posts 20, and drift eliminator support posts 21. Generally horizontal structural members such as wooden ties 22 and 23 interconnect the various posts and columns.

A plurality of unitary beam hanger clips 25 stamped from metal are spaced at predetermined intervals along some of the horizontal ties. Each clip has an upper support arm 26 and an integral downwardly extending body portion 27. The lowest terminal edge of each body portion has a notch 29 centered in it. Each notch 29 defines an upwardly extending slot 30 which merges into a semicircular opening 31. Each opening 31 terminates in a pair of identical generally horizontal, upwardly facing shelves 32 aligned on opposite sides of the slot 30. Each shelf 32 includes a generally horizontal tab 33 of metal bent so that it is normal to the plane of the lower part of its body portion 27. A downwardly extending perpendicular rib 34 connects each tab 33 to its body portion, and the ribs 34 facing each other on opposite sides of each slot 30 increase the depth of such slot. Each arm 26 has a portion punched downwardly at right angles to provide an integral spike 35 that can be pressed or hammered into a tie 22 so as to immobilize clip 25.

Figure 2:
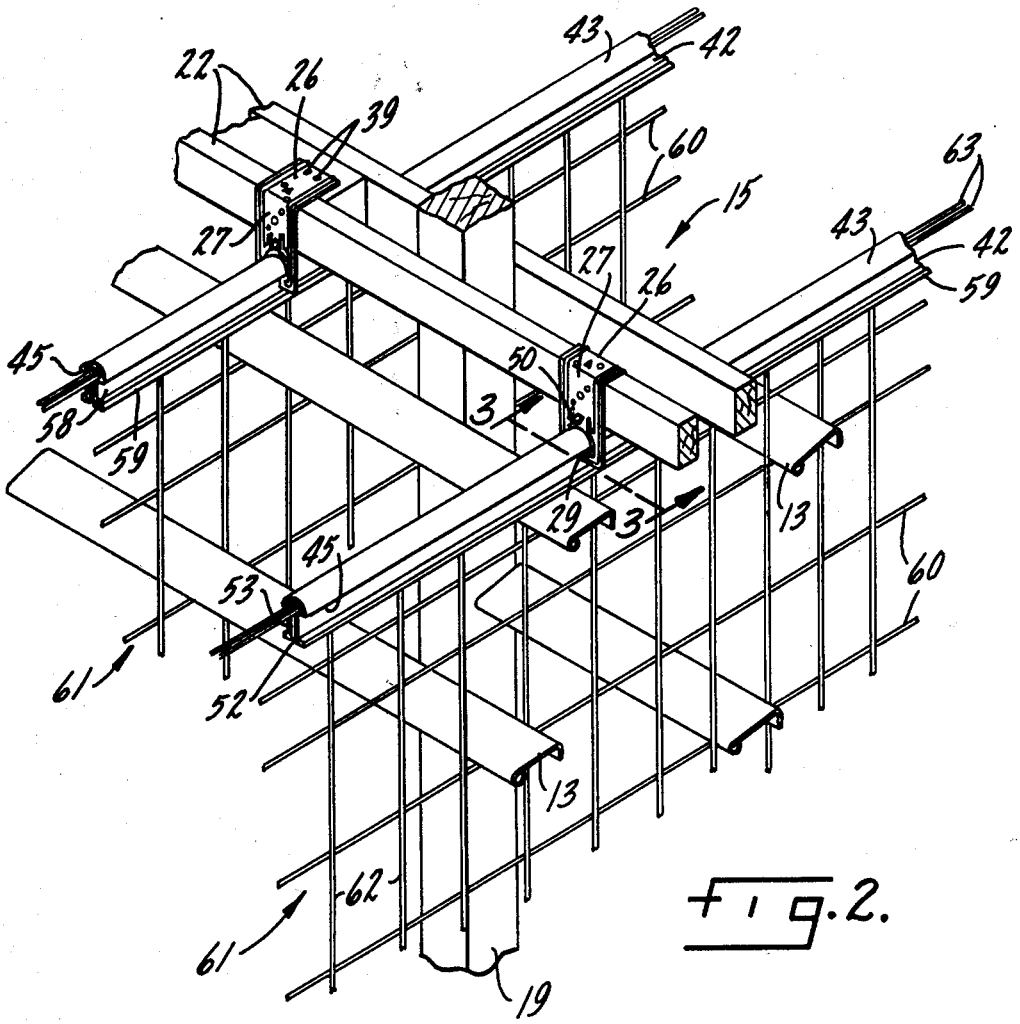
FIG. 2 is an enlarged isometric view of a portion of a fill hanger assembly in accord herewith.
Figure 3:
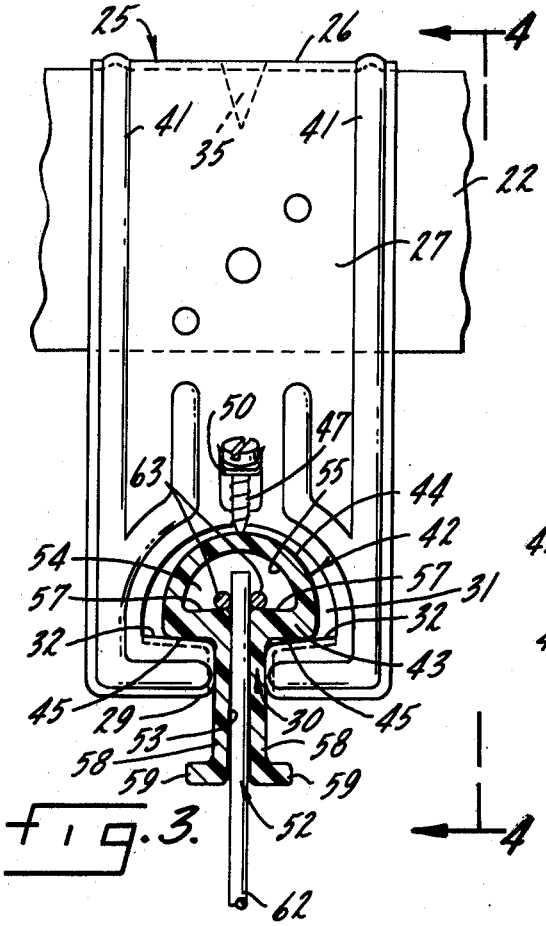
FIG. 3 is an enlarged cross sectional view taken along the line 3—3 in FIG. 2.
Figure 4:
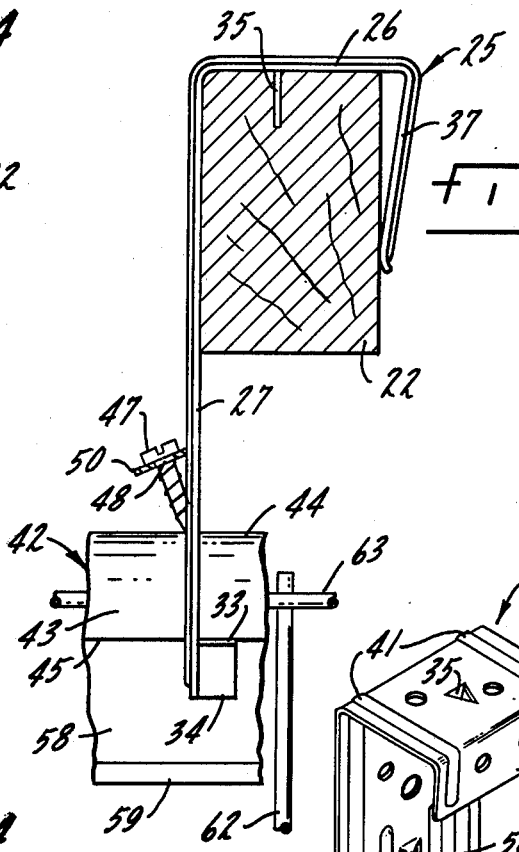
FIG. 4 is a view taken along the line 4—4 in FIG. 3.
Figure 5:
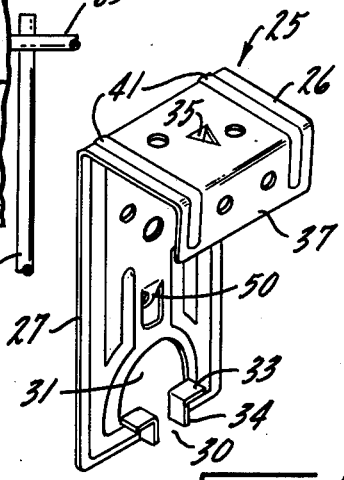
FIG. 5 is an isometric view of the beam hanger clip shown in FIGS. 3 and 4.
Figure 6:
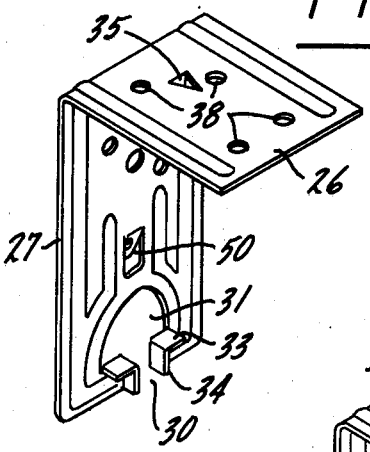
FIG. 6 is an isometric view of another form of beam hanger clip.
Figure 8:
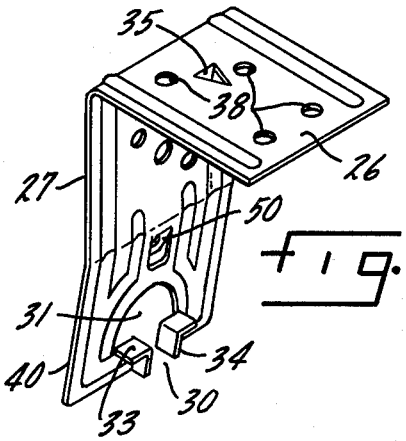
FIG. 8 is an isometric view of another form of beam hanger clip.

Most clips 25 have a downwardly extending flange 37 at the end of arm 26 opposite to body portion 27 for hooking over a tie member 22 or 23. Flange 37 resiliently grips the tie member because the distance separating the innermost edge of the flange from body portion 27 is less than the thickness of the tie member, which flexes flange 37 outwardly. At some locations in tower 10, ties may be spliced to each other or some other structural member or connection may produce an area that is too wide for an arm 37 to hook over a tie at the proper place. In such locations a clip 25 as shown in FIGS. 6 and 8 may be employed. There is no downwardly extending flange on the arm 26 of such clips, and as shown in FIG. 2 the clips are secured to a tie or other horizontal structural member by nails 39 which pass through the holes 38 in arm 26.

Figure 7:
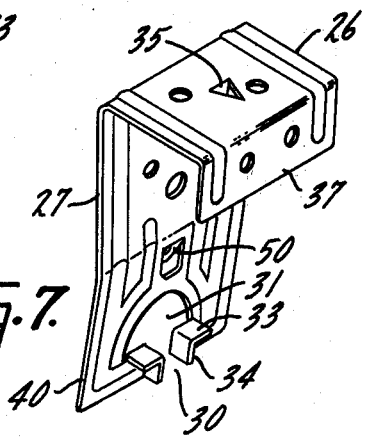
FIG. 7 is an isometric view of another form of beam hanger clip.

Ties 23 are attached to louver support posts 20 or other structural columns which are generally but not exactly vertical. This causes the body portions of the clips 25 connected to ties 23 to extend at an angle to the vertical. Since it is necessary for the slots 30 and the openings 31 in clips 25 to be essentially vertical, in FIGS. 7 and 8 the lower part 40 of body portion 27, which includes slot 30 and opening 31, lies in a plane which makes an obtuse angle of about 100° with arm 26. This compensates for misalignment that would be caused by the deviation of louver columns 20 from the vertical. Thus a clip as shown in FIG. 8 would only be used when a splice or other joint that widens the tie occurs on a horizontal member supported by a column that is not exactly vertical. Clips 25 may have additional holes for nails or other fasteners, and reinforcing ribs 41 are used where needed.

The clips 25 on adjacent ties 22 and 23 are generally aligned in series as shown in FIG. 1. This results in the notches 29 of the clips in each series being generally aligned so that each series of notches can receive and support a generally horizontally extending fill hanger beam 42. Each beam 42 is an identical unitary, hollow, fiberglas-reinforced, plastic pultrusion having an enlarged upper end 43. The uppermost surface of end 43 defines a first semicircular arc 44. Each end of arc 44 terminates in a generally horizontal, inwardly extending, downwardly facing shoulder 45. Each shoulder 45 is supported on the transversely aligned shelves 32 of a series of aligned clips 25. A screw 47 may be inserted through hole 48 in a protrusion 50 punched so as to project from the body portion 27 of each clip 25 on the side opposite arm 26. Screw 47 is threaded into end 43 to prevent beam 42 from sliding out of aligned notches 29. One screw 47 is all that is ordinarily required to anchor each beam 42.

A passage 52 extends upwardly from the center of the lowermost terminal edge of each beam 42 and passes completely through each beam. Each passage 52 defines a generally vertically extending slit 53 which merges into an enlarged opening 54 at the interior of the beam. Opening 54 defines a second semicircular arc 55 which is concentric with first arc 44. Arc 55 terminates in a pair of identical generally horizontal ledges 57 aligned on opposite sides of slit 53. An elongated flange 58 extends downwardly from each ledge 57, and flanges 58 face each other on opposite sides of slit 53. Each flange 58 terminates in an enlarged lip 59. Lips 59 extend the full length of beam 42 at the entrance to slit 53.

Fill strips 13 rest on the generally horizontal and parallel wire strands 60 of fill hanger grids 61. Strands 60 are welded to generally vertical and parallel wire strands 62 so as to form a generally parallelogram-shaped lattice of holes. An enlargement, such as a pair of horizontal wire strands 63 welded in the same plane to opposite sides of vertical strands 62, is attached to the upper end of each grid 61. The enlarged upper end of each grid 61 is passed horizontally through the opening 54 in a beam 42 and each strand 63 of the uppermost pairs rests on one of the ledges 57. Strands 62 extend downwardly from the enlarged upper end through the slit 52 in beam 42 and the slots 30 in the clips 25 supporting such beam. The holes in adjacent grids 61 are generally aligned so that fill strips 13 can be slid horizontally into place through them. The bottom end of each grid 61 can be held in place by looping a piece 64 of wire or rope around the lowermost strand 60 of such grid and the beam 42 of the next lower fill assembly. This can also be accomplished by using a staple or a hook nail fastened to the next lower tie or cross member.

It has thus been shown that by the practice of this invention the splash fill 13 of a cooling tower 10 can be supported in a way that does not require hanger grids 61 to extend up to or beyond the supporting structural members. Yet the weight of the fill and grids 61 is uniformly distributed to beam 43 by a pair of uppermost strands 63; this prevents the stress concentrations and grid strand failure that occur when such grids are suspended directly from hooks. It is possible to align several grids 61 at ground level, slide fill strips 13 into place, attach a beam 43 to each such grid, and raise the resulting rectangular fill assembly as a single unit to the elevation of the series of aligned clips 25; then beams 43 would be slid horizontally through aligned openings 31 until the assembly is properly located, and finally a screw 47 would be threaded into the outer end of each beam. This would reduce to a minimum the time that workers have to spend at dangerous heights.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. In a cooling tower in which air flows through splash fill within the tower in cooling relationship with a liquid falling through said fill, an improved splash fill assembly comprising:

(a) a plurality of column means extending generally vertically in said tower;

(b) generally horizontal members connected to said column means;

(c) a plurality of beam hanger clips supported by each horizontal member at spaced intervals therealong, the hanger clips on adjacent horizontal members being generally aligned in series;

(d) an elongated generally horizontal fill hanger beam supported by each series of aligned clips;

(e) a fill hanger grid supported at its upper end by each fill hanger beam, each grid comprising generally horizontal and vertical strands connected so as to form a lattice of holes, the holes on adjacent grids being generally aligned, and (f) a plurality of generally horizontal splash fill members extending through said aligned holes in said grids and being supported on said generally horizontal strands.

2. The invention defined in claim 1 wherein said fill hanger beam comprises: an enlarged upper end having an uppermost surface defining a first semicircular arc each end of which terminates at an inwardly extending downwardly facing shoulder, a passage extending upwardly from the center of the lower most terminal edge of said beam defining a slit which merges into an enlarged opening at the interior of said beam, said passage extending completely through said beam, said opening defining a second semicircular arc concentric with said first arc, and said second arc terminating in upwardly facing ledges aligned on opposite sides of said slit.

3. The invention defined in claim 2, wherein an elongated flange extends downwardly from each of said ledges on opposite sides of said slit, each such flange terminating in an enlarged lip.

4. The invention defined in claim 1 wherein said beam hanger clip comprises: an upper support arm and a downwardly extending body portion, the lowest terminal edge of said body portion having a notch centered therein, said notch defining an upwardly extending slot which merges into a enlarged semicircular opening that terminates in upwardly facing shelves aligned on opposite sides of said slot.

5. The invention defined in claim 4, wherein each shelf includes a tab extending normal to the plane of said body portion.

6. The invention defined in claim 4, wherein a spike punched from and extending downwardly from said arm is adapted to immobilize said clip by penetrating one of said members.

7. The invention defined in claim 4, wherein said arm has a downwardly extending flange on the side opposite to said body portion for hooking over one of said members.

8. The invention defined in claim 4, wherein said body portion is perpendicular to said arm.

9. The invention defined in claim 4, wherein the part of said body portion including said notch and lowermost edge lies in a plane which makes an obtuse angle with said arm.

10. The invention defined in claim 9, wherein said angle is about 100°.

11. The invention defined in claim 4, further comprising a protuberance projecting from said body portion on the side opposite to said arm, and there being a hole in said protuberance for receiving a fastener attached to said beam.

12. The invention defined in claim 1, wherein each of said beam hanger clips has a notch in its lowest terminal edge, said notch defining a vertical slot which merges into an enlarged opening that defines a pair of generally horizontal shelves aligned on opposite sides of such slot, the aligned hanger clips on adjacent horizontal members having their notches generally aligned in series.

13. The invention defined in claim 1, wherein each of said fill hanger beams has an enlarged upper end defining a pair of shoulders on its underside, the shoulders of each beam resting on the aligned clips in its series, each beam having a passage at its lowest terminal edge defining a vertical slit which merges into an enlarged opening at the interior of said beam, said slit defining a pair of generally horizontal ledges aligned on opposite sides thereof.

14. The invention defined in claim 13, wherein each of said fill hanger grids has an enlargement attached at its upper end, each of said enlargements passing into the enlarged opening in one of said beams and being supported by said ledges of such beam so that such grid extends downwardly through said slit in such beam.

15. The invention defined in claim 14, wherein said enlargement at the upper end of said grids comprises a pair of said horizontal strands aligned with each other in the same plane on opposite sides of said vertical strands.

16. In a cooling tower in which air flows through splash fill within the tower in cooling relationship with a liquid falling through said fill, an improved splash fill assembly comprising:

(a) a plurality of column means extending generally vertically in said tower;

(b) generally horizontal members connected to said column means;

(c) a plurality of beam hanger clips supported by each horizontal member at spaced intervals therealong, each clip having a notch in its lowest terminal edge, said notch defining a vertical slot which merges into an enlarged opening that defines a pair of generally horizontal shelves aligned on opposite sides of such slot, the hanger clips on adjacent horizontal members having their notches generally aligned in series;

(d) a fill hanger beam extending through each series of aligned notches, each beam having an enlarged upper end defining a pair of shoulders on its underside, the shoulders of each beam resting on the shelves of the aligned clips in its series, each beam having a passage at its lowest terminal edge defining a vertical slit which merges into an enlarged opening at the interior of said beam, said slit defining a pair of generally horizontal ledges aligned on opposite sides thereof;

(e) a plurality of fill hanger grids each comprising generally parallel and horizontal strands which intersect and are attached to generally parallel and vertical strands so as to form a vertically extending generally parallelogram shaped lattice of holes, each grid having an enlargement attached at its upper end, each of said enlargements passing into the enlarged opening in one of said beams and being supported by said ledges of such beam so that such grid extends downwardly through said slots in said clips and said slit in said beam, the holes in adjacent grids being generally aligned; and (f) a plurality of generally horizontal splash fill members extending through said aligned holes in said grids and being supported on said generally horizontal strands.

17. The invention defined in claim 16 wherein said fill hanger beam is hollow and said passage extends completely therethrough.

18. The invention defined in claim 17, wherein the upper surface of said enlarged upper end defines a semicircular arc that terminates at said shoulders, and said enlarged opening defines a concentric semicircular arc that terminates at said ledges.

19. The invention defined in claim 16, wherein said fill hanger beam has enlarged lips extending its full length on opposite sides of the entrance of said slit.

20. The invention defined in claim 16, wherein each beam hanger clip comprises a generally horizontal upper arm supported by and in contact with the uppermost surface of a horizontal member and an integral downwardly extending body portion including said lowermost edge and notch.

21. The invention defined in claim 20, wherein said upper arm is secured to said member by a fastener passing through said arm into said member.

22. The invention defined in claim 20, wherein said arm has an integral downwardly extending flange on the side opposite said body portion that hooks over said horizontal member.

23. The invention defined in claim 20, wherein said body portion is perpendicular to said arm.

24. The invention defined in claim 20, wherein the part of said body portion including said notch and lowermost edge lies in a plane which makes an obtuse angle with said arm.

25. The invention defined in claim 16, wherein said enlargement at the upper end of said grids comprises a pair of said horizontal strands aligned with each other in the same plane on opposite sides of said vertical strands.

26. In a cooling tower in which air flows through splash fill within the tower in cooling relationship with a liquid falling through said fill, an improved splash fill assembly comprising:

(a) a plurality of posts extending generally vertically in said tower;

(b) generally horizontal ties connected to said posts;

(c) a plurality of unitary beam hanger clips each having an upper horizontal support arm attached to a tie at spaced intervals therealong, each clip having a downwardly extending body portion with a notch centered in its lowest terminal edge, said notch defining a vertical slot which merges into an enlarged semicircular opening that terminates in a pair of generally horizontal shelves aligned on opposite sides of such slot, the hanger clips on adjacent ties having their notches generally aligned in series;

(d) a unitary fill hanger beam extending through each series of aligned notches, each beam having an enlarged upper end defining a first semicircular arc that terminates in a pair of shoulders on its underside, the shoulders of each beam resting on the shelves of the aligned clips in its series, each beam being hollow and having a passage extending completely therethrough at its lowest terminal edge, said passage defining a vertical slit which merges into an enlarged opening at the interior of said beam, said opening defining a second semicircular arc concentric with said first arc, said second arc terminating in generally horizontal ledges aligned on opposite sides of said slit;

(e) a plurality of fill hanger grids each comprising generally parallel and horizontal strands which intersect and are attached to generally parallel and vertical strands so as to form a vertically extending generally parallelogram shaped lattice of holes, each grid having a pair of horizontal strands attached to its upper end, said pair of strands passing through the enlarged opening in one of said beams and each strand of said pair being supported on one of said ledges of such beam so that such grid extends downwardly through said slots in said clips and said slit in said beam, the holes in adjacent grids being generally aligned; and (f) a plurality of generally horizontal splash fill members extending through said aligned holes in said grids and being supported on said generally horizontal strands.

27. The invention defined in claim 26, further comprising a protuberance extending from said body portion of said beam hanger clips, a screw passing through a hole in the protuberance in at least one clip in each of said series of aligned clips, and said screw being threaded into the fill hanger beam supported by each such series of clips.

* * * * *